United States Patent [19]

Franks

[11] 4,214,842

[45] Jul. 29, 1980

[54] REMOTELY CONTROLLED MANEUVERABLE TOOL MEANS AND METHOD FOR POSITIONING THE END OF A PIPE STRING IN OFFSHORE WELL OPERATIONS

[75] Inventor: Neal S. Franks, Huntington Beach, Calif.

[73] Assignee: Deep Oil Technology, Inc., Irvine, Calif.

[21] Appl. No.: 900,500

[22] Filed: Apr. 27, 1978

[51] Int. Cl.[2] ..... E21B 7/12

[52] U.S. Cl. ..... 405/191; 166/349; 166/341; 175/7; 294/66 A; 405/195

[58] Field of Search ..... 166/353, 341, 344, 338, 166/342, 349, 366; 294/66 R, 66 A; 214/DIG. 2; 285/21; 175/5; 405/191, 195

[56] References Cited

U.S. PATENT DOCUMENTS

| | | | |
|---|---|---|---|
| 3,189,105 | 6/1965 | Bates et al. | 175/5 |
| 3,191,695 | 6/1965 | Bates et al. | 175/5 |
| 3,199,613 | 8/1965 | Malott et al. | 175/5 |
| 3,215,202 | 11/1965 | Pollard et al. | 166/341 |
| 3,265,130 | 8/1966 | Watkins | 166/342 |
| 3,512,592 | 5/1970 | Kellner | 175/5 |
| 3,664,442 | 5/1972 | Rosser et al. | 166/341 |
| 3,788,396 | 1/1974 | Shatto et al. | 166/341 |
| 3,795,114 | 3/1974 | Cremiers et al. | 166/341 |
| 3,973,635 | 8/1976 | Gatlin et al. | 166/349 |
| 4,031,544 | 6/1977 | Lapetina | 166/341 |

*Primary Examiner*—Ernest R. Purser
*Assistant Examiner*—Richard E. Favreau
*Attorney, Agent, or Firm*—Poms, Smith, Lande & Rose

[57] ABSTRACT

A maneuverable tool means for continuously maneuvering and controlling a pipe string end as it is lowered for engagement with a selected well part at the sea floor. The tool means comprises a body member attachable to the pipe string end, the body member carrying laterally directed thrust means; fluid pressure means in communication with the thrust means to impart thrust forces to the pipe string end and a remote control system for the fluid pressure means. The tool means also includes TV and sonar systems to sense the presence of adjacent objects as the pipe string end is lowered and to identify a well part with which the tool is to be cooperably associated. The tool means is provided with a lock means for temporarily retaining the tool means in a selected position in a guide funnel on a well template to facilitate installation of a guide line base means on the template.

6 Claims, 5 Drawing Figures

Fig. 3.
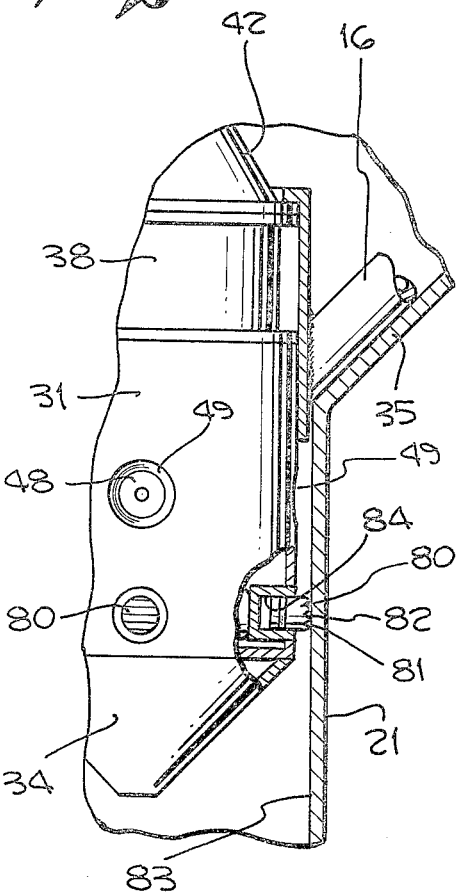
Fig. 4.
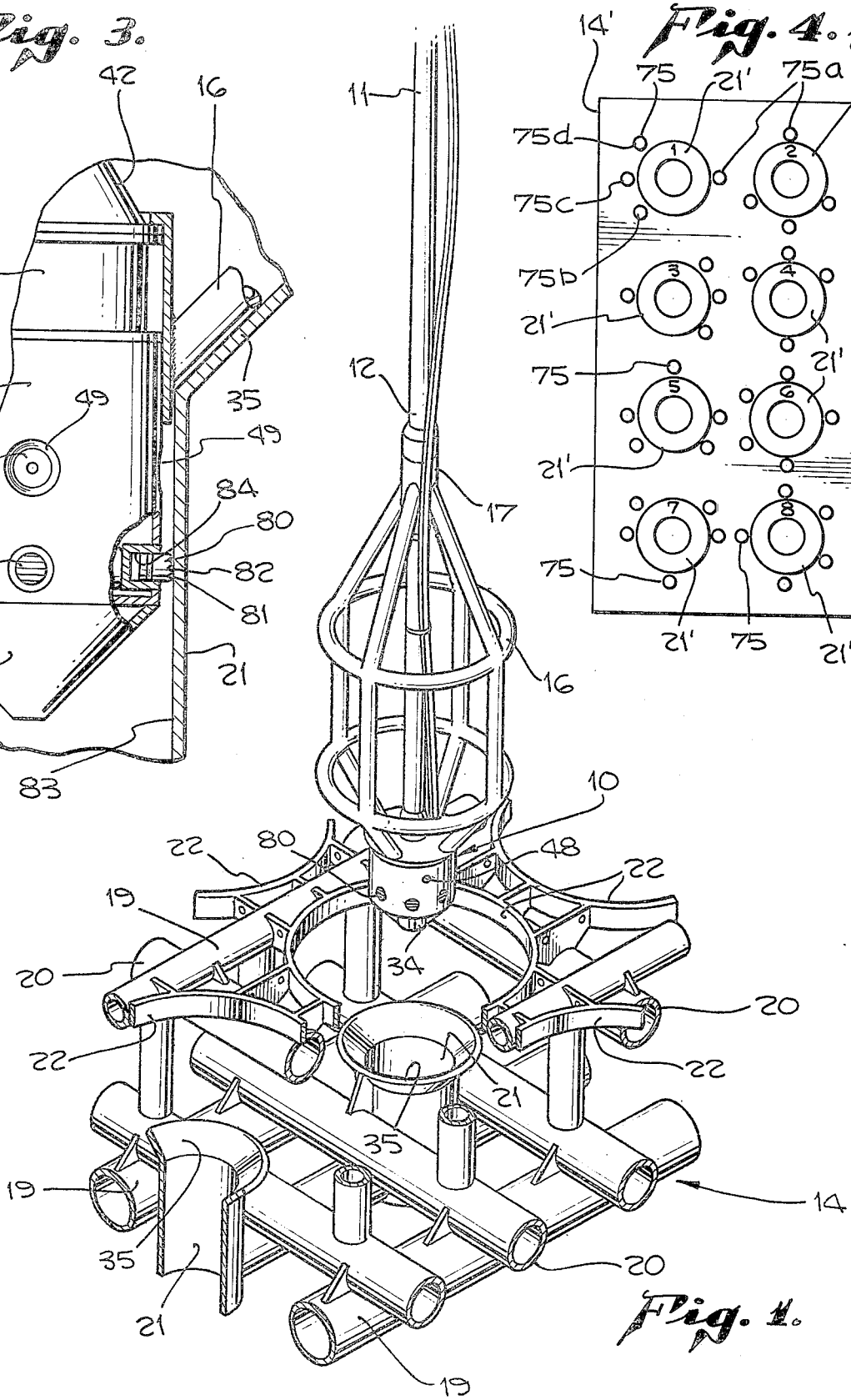
Fig. 1.

REMOTELY CONTROLLED MANEUVERABLE TOOL MEANS AND METHOD FOR POSITIONING THE END OF A PIPE STRING IN OFFSHORE WELL OPERATIONS

BACKGROUND OF INVENTION

The present invention is concerned with conveniently and rapidly initially engaging or contacting a well part at the sea floor from a floating vessel in relatively deep water. Prior proposed systems for making such contact have provided a guide post means on a sea floor well template and acoustic controlled means for bringing a guide line to the top end of the guide post and attaching the guide line thereto. In such prior proposed systems, a guide post was necessary on the sea floor well template.

Other prior proposed systems for initially contacting a sea floor template included lowering a pipe string from a floating vessel to engage a cooperable part on a sea floor template. The bottom end of the pipe string was laterally moved by lateral movement of the floating vessel. In deep water, it will be apparent that lateral displacement of the vessel and the relative lateral displacement of the pipe string end near the sea floor incorporated a substantial time lag. Accurate control of lateral displacement of the submerged pipe end by movement of the vessel was very difficult and time consuming.

When such a prior pipe string was coupled together with the pipe sections, as the lower end of the pipe string reached the vicinity of the well template, pressure fluid was introduced through the pipe string for discharge from nozzles at the lower end of the pipe string to laterally displace the end of the pipe string so that proper mating with a well template part could be accomplished. The use of such pressure fluid means in a pipe string was usually controlled by valve means at the floating vessel. In long pipe strings, it is obvious that displacement of the submerged pipe string end to a preselected position at the sea floor was difficult because of delayed response of the pipe string end to fluid pressure control at the floating vessel.

Such prior proposed systems which lowered a pipe string to a well template included disadvantages in that control of the bottom end of the pipe string was erratic and imprecise and was not predictably repeatable. Another disadvantage was that since the control valves for the fluid pressure were located at the vessel and not at the pipe string end and since the pipe string was often used as a conduit for the fluid pressure means, continuous control of the pipe end as it descended was not possible, and only became possible when the pipe end was adjacent the sea floor.

In deep water installations, it is desirable that the descending pipe string end be under control at all times. In a system for conducting well operations as described in copending application Ser. No. 889,112 owned by a common assignee, a plurality of riser pipe string may extend between the multiwell template and the floating vessel. It is desirable that the lower end of the descending pipe string remain clear of other objects in the vicinity to prevent entanglement therewith. Further, in some multiwell template means, precise control of the location of the bottom end of the riser pipe adjacent the template means is necessary to move the pipe string end into desired engagement with the template means while avoiding other objects in the immediate vicinity.

SUMMARY OF INVENTION

The present invention relates to a maneuverable tool device and method of connecting the device to a well template wherein the descending end of the pipe string is subject to continuous control as to its position or location as it is lowered.

The present invention contemplates a novel maneuverable tool means which is readily attachable to the lower end of a pipe string. Control communication with the tool device is continuous as it descends and is provided by an umbilical control line run externally alongside the pipe string. The tool device is provided with thrust means operable just below the pipe string end, a sensing means in the form of a TV camera, lights, and sonar which permit an operator on the vessel to view the vicinity of the lower end of the pipe string as it descends; and lock means for permitting temporary attachment or engagement with a selected guide funnel on the sea floor well template means.

The main object of the present invention is to provide a novel maneuverable tool means and a method of controlling lateral motion thereof whereby desired contact and engagement with a sea floor well template is readily accomplished.

An object of the present invention is to provide a maneuverable tool means including control means therefor whereby the path taken by the descending pipe string end is continuously controlled for the entire descent of the pipe string end.

Another object of the present invention is to provide such a maneuverable tool means which is controllable through use of a continuous external umbilical line for remote operation of the tool means from a floating vessel.

A further object of the present invention is to provide a novel maneuverable tool means wherein valve means for controlling thrust means in the tool body are located in the tool body adjacent the thrust means.

A still further object of the present invention is to provide lock means on the tool body for remote actuation when the tool body reaches a desired position with respect to a well part such as a template guide funnel.

Another object of the invention is to provide a maneuverable tool means and a sea floor template construction adapted to accommodate a plurality of wells wherein the identity of each well is in coded form to assure that the pipe string end is positioned in a selected well part.

Various other objects and advantages of the present invention will be readily apparent from the following description of the drawings in which an exemplary embodiment of the invention is shown.

IN THE DRAWINGS

FIG. 1 is a perspective view of a fragment of a sea floor well template and a pipe string being lowered into association with the template, the pipe string having attached thereto a tool means embodying this invention.

FIG. 3 is an enlarged fragmentary sectional view showing the tool means in locked relation with a guide funnel on the template means.

FIG. 4 is a schematic plan view of a multiwell sea floor template showing an exemplary system for identification of each well hole and guide funnel associated therewith.

Figure 2:
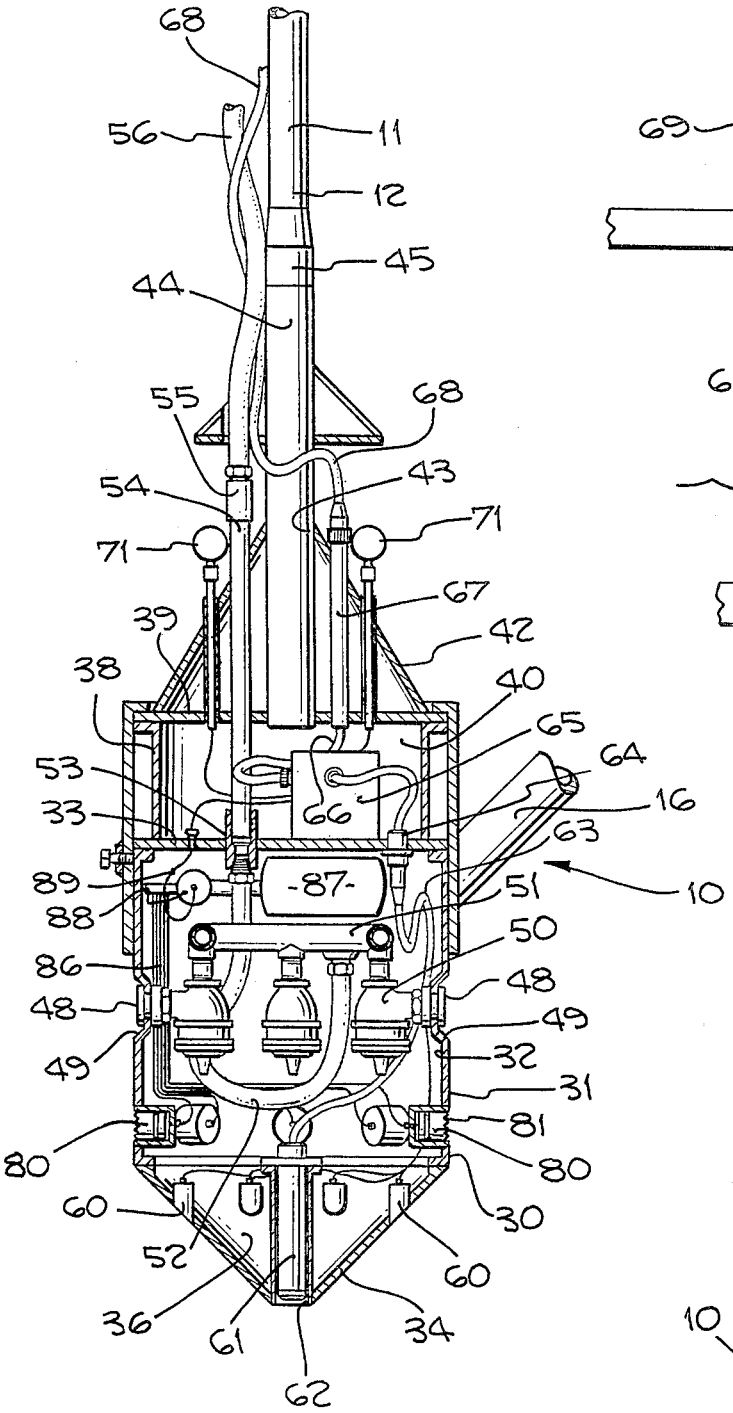
FIG. 2 is an enlarged fragmentary sectional view of the tool means of this invention.
Figure 5:
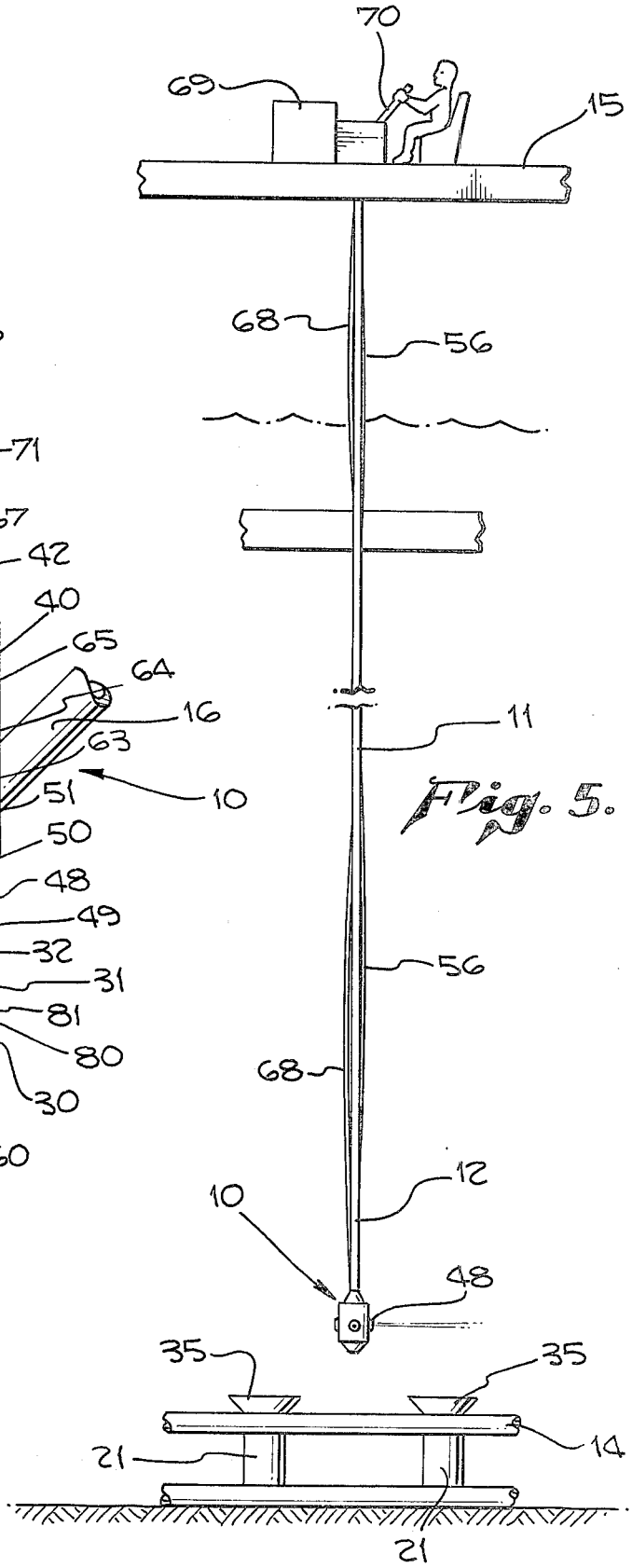
FIG. 5 is a schematic view of a vessel over a sea floor template, a descending pipe string provided with tool means of this invention, and a control console and control stick for the tool means on the vessel.

A maneuverable tool means generally indicated at 10 embodying this invention is shown in FIG. 1 and FIG. 5 as connected to the lower end 12 of a stabbing pipe string 11. In FIG. 5, tool means 10 is schematically illustrated without a protective cage means over a multiwell template means 14. Lateral movement of tool means 10 may be be controlled from a floating vessel or a platform generally indicated at 15 as later described.

Referring particularly to FIG. 1, pipe string 11 may be connected at its bottom end 12 to a cage means 16 by suitable connector at 17. Cage means 16 may be of the construction described in copending application Ser. No. 901,468, now U.S. Pat. No. 4,155,672 issued by May 22, 1979 owned by a common assignee.

Multiwell template means 14 may include suitable arranged longitudinal frame members 19 and transverse members 20 interconnected in suitable structural relationship. Template means 14 provides one or more guide funnels 21 indicating location of well holes drilled or to be drilled, each guide funnel 21 being fixedly connected to the template means 14. Above each guide funnel may be provided a latch ring member 22 coaxially aligned with guide funnel 21 for cooperable latch engagement with a guide line base frame as described in said copending application Ser. No. 899,112. Latch ring member 22 on the template means readily receives therein cage 16 and generally coacts with cage 16 to guide tool means 10 into guide funnel 21. It will be understood that well template means 14 may include other types and arrangements of frame structures, guide funnels and means for attaching other well equipment to the template means.

Tool means 10 of this invention comprises a tool body member 30 having a cylindrical wall 31 defining a chamber 32. Chamber 31 is closed at its top end by a wall or bulkhead 33 and at its bottom end by a conical wall 34 for guiding cooperation with the outwardly flared top end 35 of guide funnel 21. Chamber 32 and the conical chamber 36 are not sealed and may contain sea water.

Bulkhead 33, together with a cylindrical wall 38 and a top wall 39, define a sealed dry chamber 40 for control equipment, as later described, which is desired to be maintained in dry condition. Above wall 39 tool means 10 includes a conical wall 42 which has a port 43 at its vertex for reception therewithin of a connector pipe 44 which provides a connector member 45 for connection to the lower end of pipe string 11. Connector pipe 44 has a closed bottom end which extends through wall 39 and is welded thereto.

Thrust means for imparting lateral motion to the lower end of pipe string 11 and tool means 10 may be carried within chamber 32 of the tool body member 31. In this example, the thrust means includes a thrust nozzle 48 extending through wall 31 at a circular recessed portion 49 thereof to permit the outer surface of nozzle 48 to lie within the cylinder generally defined by wall 31. Nozzle 48 is in fluid communication with thrust valve means 50, each of which is connected to a manifold 51. In this example, it is contemplated that four thrust valve means 50 are located with 90° C. spacing within the chamber 32, each having a thrust nozzle 48 directed along a path at 90° C. to the adjacent nozzle. Manifold 51 may be connected through a suitable flexible hose 52 and through a water tight pressure tight fitting 53 to an extension 54 which may be connected at 55 to a flexible line 56 extending along pipe string 11 to the floating vessel 15. Suitable pressure fluid may be carried in line 56 and manifold 51 so that upon actuation of a selected thrust valve means 50 a jet of pressure fluid will be discharged through thrust nozzle 48 for imparting a force to the tool means 10 to cause it to move in a direction opposite to the thrust discharge.

Means on said tool means 10 for sensing and locating said tool means and the lower end of the pipe string 11 with respect to other objects in the vicinity of tool means as it descends to the sea floor and at the sea floor may include downwardly directed lights 60 in the tapered end 34 or nose of the body member 30 to illuminate the downward path of travel of the tool means for a TV and sonar means 61 located coaxially of the nose 34 and having a viewing port 62 at the vertex of the cone. The TV and sonar means 61 may be connected through a control line 63 to a TV and sonar means or package 65 located in the dry chamber 40. Control line 63 is passed through bulkhead 33 by means of a water tight seal fitting 64. The TV and sonar means is connected through a flexible control line 66 and a rigid control tube 67 to a flexible, umbilical control line 68 which extends externally alongside pipe string 11 to a control console 69 on the deck of vessel 15.

Suitable sonar transducers 71 may project above the conical wall 42 of the tool means 10 and may be suitably connected through bulkhead 39 to the sonar package means 65 to provide sideward observation as the tool means 10 descends to the sea floor.

The remote control means for controlling the position of the tool means 10 and the lower end of the pipe string 11 includes the control console 69, FIG. 5, and a control stick 70. The control console 69 may include a cathode ray tube display connected with the TV and sonar for indicating the position of the tool means. The control stick 70 may be manipulated to control the pressure fluid discharged through the thrust nozzle 48 so that lateral control of the position of the tool means 10 is precise. Automatic computer control may also be used to control the tool means 10. With such accurate lateral control of tool means 10, the lower end of the pipe string 11 can be readily located over a selected guide funnel 21 or guided between adjacent riser during descent.

Means for selecting a guide funnel 21 or a well hole for reception of tool means 10 is schematically illustrated in FIG. 4 wherein an eight well template means 14' is shown with a plurality of guide funnels 21' arranged in two rows. Around each well axis, a coded arrangement of sonar identifiable reflector means 75 are provided. Any coding arrangement may be used, in this example, the first four well holes as designated on FIG. 4 include an arrangement of four sonar reflectors having a key reflector **75*a* located on well hole 1 at three o'clock and three reflectors 75*b*, *c* and *d* located at approximately seven, nine and eleven o'clock. This arrangement is rotated counterclockwise for well hole 2 through approximately 90° C. Counterclockwise rotation for well holes 3 and 4 through 90°, respectively, provides four different arrangements of the reflector 75** for identification of the well hole.

With respect to well holes 5–8 inclusive, five reflectors 75 are provided in a selected pattern, the pattern being rotated about the axis of the well hole to provide identification of well holes 6, 7 and 8.

By means of such coded reflector systems, it is readily apparent that the downwardly looking TV and sonar 61 on the tool means 10 may readily identify a selected well hole for further well operations.

When the maneuverable tool means 10 has been located above a selected template guide funnel 21, the pipe string 11 may be lowered so that the tool means 10 enters guide funnel 21 to the extent permitted by the cage 16. When the tool means 10 is positioned in the guide funnel, lock means may be actuated by the operator at the vessel to lock the tool means in relation to the guide funnel 21 and to hold the pipe string in selected position with respect to the well template means. Such lock means may comprise a plurality of angularly spaced lock members 80 having serrated or irregular lock faces 81 for engagement as at 82, FIG. 3, with the internal cylindrical surface 83 of the guide funnel 21. Each lock member 80 comprises, in effect, a piston operable within a piston chamber 84 by actuating pressure fluid conducted to the end of the cylinder 84 by pressure lines 86 which are in communication with a pressure fluid accumulator 87 carried in chamber 32. A pressure fluid actuating valve 88 is suitably controlled by a control line 89 which extends through the control umbilical 68 to the floating vessel and the control console 69.

The lock elements 80 are readily released by actuation of the valve 89 to relieve pressure thereagainst to permit withdrawal of the tool means 10 from the guide funnel 21 when desired.

When attached to the free end of a pipe string, the maneuverable tool means 10 of this invention provides precise continuous control of the descending pipe string end. Remote control at the vessel of thrust valve means operable at the tool means and immediate continual observation of the response of the tool means during descent and at the sea floor permits an operator to avoid adjacent risers or other well equipment and to accurately move the tool means over a selected guide funnel or other well part. The tapered nose of tool means 10 facilitates guiding of the tool means into a guide funnel or into alignment with a receptor well part. Latching and unlatching of the tool means to the receptor funnel is readily accomplished by actuation of the latch or lock members 80.

it will be understood that in some installations the use of a cage means 16 between the manipulator tool means 10 and the pipe string end 12 may not be necessary. Since the diameter of the cage means 16 is greater than the diameter of the tool body member, it will be understood that the tool body member is protected to a certain degree against contact with pipe strings or risers or other well parts located sidewardly of the tool means.

It will be understood that various changes and modifications may be made in the embodiment of the invention described hereinabove and which may come within the spirit of this invention and all such changes and modifications coming within the scope of the appended claims are embraced thereby.

I claim:

1. A maneuverable tool means for attachment to the end of a pipe string to maneuver the position of the pipe string end during lowering to and for alignment with a well part, comprising a tool body member adapted to be connected to the end of a pipe string and having a wall defining a chamber;

thrust means including thrust valve means within said chamber, said thrust means having a discharge nozzle externally of said wall and directed radially laterally of the body member;

fluid pressure means in communication with the thrust means for selectively imparting thrust forces to move the tool body member and the end of the pipe string;

and remote control means for said fluid pressure means and operation of said thrust valve means at said tool body member.

2. A tool means as claimed in claim 1 wherein said remote control means includes cathode ray tube display means provided on a vessel from which said pipe string is lowered;

and control stick means for maneuvering said tool means at the end of said pipe string.

3. A maneuverable tool means for alignment with a well part, comprising:

a tool body member having a chamber and including a connector pipe secured to said body member and adapted to be connected to a drill pipe;

thrust means carried by the tool body member including a plurality of thrust nozzles for directing thrust forces radially outwardly of the tool body member, a valve means within said chamber for each thrust nozzle, a fluid pressure manifold within said chamber in communication with said nozzles and with a fluid pressure source connected to said tool body member;

and remote control means for actuating each of said valve means for said thrust nozzles for controlling movement of said thrust body member at the end of a drill pipe.

4. A tool means as stated in claim 3 including a pressure fluid accumulator within said tool body member chamber;

lock means carried by said body member and in communication with said accumulator for actuation of said lock means.

5. A tool means as stated in claim 3 wherein said tool body member includes an upper sealed dry chamber portion, and a lower unsealed wet chamber portion containing said thrust valve means and thrust nozzles.

6. A tool means as stated in claim 5 wherein said upper sealed dry chamber portion includes TV and sonar means in communication with remote control means and with TV and sonar cameras and sensors carried by the body member.

* * * * *